US011034921B2

(12) United States Patent
Prince

(10) Patent No.: US 11,034,921 B2
(45) Date of Patent: Jun. 15, 2021

(54) METHOD, KIT, AND COMPOSITION FOR CORROSION REMOVAL

(71) Applicant: Adam Mason Prince, Henrietta, NY (US)

(72) Inventor: Adam Mason Prince, Henrietta, NY (US)

( * ) Notice: Subject to any disclaimer, the term of this patent is extended or adjusted under 35 U.S.C. 154(b) by 42 days.

(21) Appl. No.: 16/413,306

(22) Filed: May 15, 2019

(65) Prior Publication Data

US 2019/0352582 A1 Nov. 21, 2019

Related U.S. Application Data

(60) Provisional application No. 62/672,322, filed on May 16, 2018.

(51) Int. Cl.

| | |
|---|---|
| ***C11D 11/00*** | (2006.01) |
| ***C11D 7/08*** | (2006.01) |
| ***C11D 7/26*** | (2006.01) |
| ***C11D 7/34*** | (2006.01) |
| ***B08B 3/10*** | (2006.01) |

(Continued)

(52) U.S. Cl.

CPC ..... *C11D 7/08* (2013.01); *B08B 3/08* (2013.01); *B08B 3/10* (2013.01); *C11D 7/20* (2013.01); *C11D 7/265* (2013.01); *C11D 7/34* (2013.01); *C11D 11/0029* (2013.01); *C11D 11/0064* (2013.01)

(58) Field of Classification Search

CPC ..... C11D 3/042
USPC ..... 134/27; 510/253
See application file for complete search history.

(56) References Cited

U.S. PATENT DOCUMENTS

| | | |
|---|---|---|
| 2,120,276 A | 6/1938 | Grant |
| 2,257,467 A | 9/1941 | Jacobson et al. |

(Continued)

FOREIGN PATENT DOCUMENTS

| | | |
|---|---|---|
| CN | 104018113 | 9/2014 |
| WO | WO2007/022235 | 2/2007 |
| WO | WO2013/090268 | 6/2013 |

OTHER PUBLICATIONS

Lysol® Power Toilet Bowl Cleaner (Product Code: 1920002522) by Lysol® MSDS: Hydrochloric acid 5-10 7647-01-0 Amines, tallow alkyl, ethoxylated 1-2.5 61791-26-2 Alcohols, C12-16, ethoxylated 1-2.5 68551-12-2; www.dollartree.com, last accessed Sep. 18, 2019.

(Continued)

*Primary Examiner* — Gregory E Webb
(74) *Attorney, Agent, or Firm* — Simpson & Simpson, PLLC

(57) ABSTRACT

Methods, compositions, and kit(s) for removing corrosion or scale from a metal or a non-metal article are disclosed. In a first stage of the method, an article exhibiting corrosion can be exposed to an acid wash composition including a first acid component having one or more of HCl, Phosphoric Acid, Oxalic Acid, a second acid inhibitor/surfactant component including ethoxylated alkyl mercaptan, and a third thixotropic gelling agent component including Talc or Fumed silica, sufficient to cause gelling of the acid wash composition. In a second stage of the method performed subsequent to the first stage, the article can be exposed to an acid neutralizing composition comprising bicarbonate, borax, isopropyl alcohol and water.

11 Claims, 4 Drawing Sheets

(51) Int. Cl.
*B08B 3/08* (2006.01)
*C11D 7/20* (2006.01)

(56) References Cited

U.S. PATENT DOCUMENTS

| | | | | |
|---|---|---|---|---|
| 2,838,417 | A | | 6/1958 | Robinson et al. |
| 3,282,850 | A | | 11/1966 | Davidowich et al. |
| 3,335,090 | A | | 8/1967 | Davidowich et al. |
| 3,337,470 | A | | 8/1967 | Davidowich et al. |
| 3,345,296 | A | | 10/1967 | Lutz |
| 3,345,299 | A | | 10/1967 | Davidowich et al. |
| 3,514,410 | A | | 5/1970 | Engle et al. |
| 3,591,511 | A | | 7/1971 | Leeds |
| 3,591,512 | A | | 7/1971 | Leeds |
| 3,600,321 | A | | 8/1971 | Tedeschi et al. |
| 3,630,932 | A | | 12/1971 | Tedeschi et al. |
| 3,642,641 | A | | 2/1972 | Tedeschi et al. |
| 3,655,571 | A | | 4/1972 | Tedeschi et al. |
| 3,772,208 | A | | 11/1973 | Tedeschi et al. |
| 3,793,221 | A | | 2/1974 | Orthalek et al. |
| 3,973,998 | A | | 8/1976 | Datta et al. |
| 3,998,973 | A | | 12/1976 | Carlson |
| 4,116,713 | A | | 9/1978 | Otrhalek et al. |
| 4,302,253 | A | | 11/1981 | Ciullo |
| 4,675,120 | A | | 6/1987 | Martucci |
| 4,784,778 | A | | 11/1988 | Shin |
| 4,784,779 | A | | 11/1988 | Dadgar |
| 4,911,887 | A | | 3/1990 | Carter |
| 5,609,692 | A | | 3/1997 | Johnson et al. |
| 5,614,028 | A | | 3/1997 | Rodzewich |
| 5,672,279 | A | | 9/1997 | Sargent et al. |
| 5,797,986 | A | * | 8/1998 | Rolando ..... B08B 1/00 134/27 |
| 5,916,379 | A | | 6/1999 | Varley et al. |
| 6,153,572 | A | | 11/2000 | Stamm |
| 6,210,600 | B1 | | 4/2001 | Zhou et al. |
| 6,239,092 | B1 | | 5/2001 | Papasso et al. |
| 6,525,010 | B2 | | 2/2003 | Peterson et al. |
| 6,593,279 | B2 | | 7/2003 | Von Krosigk et al. |
| 6,683,035 | B1 | | 1/2004 | Koester et al. |
| 2003/0083223 | A1 | | 5/2003 | Aubay et al. |
| 2007/0022235 | A1 | | 1/2007 | Chen et al. |
| 2011/0061680 | A1 | | 3/2011 | Davister et al. |
| 2017/0306507 | A1 | | 10/2017 | Masuoka et al. |

OTHER PUBLICATIONS

WestKleen Xblast by WestChem Technologies Inc (Canada) MSDS: Amine, Tallow Alkyl, Ethoxylated 1-5 61791-26-2 1,500—RAT/Oral N.AV. Hydrogen Chloride 10-30 7647-01-0 900—RBT/Oral N.AV; www.westchem.ca; last accessed Sep. 18, 2019.

Tek Gel HD24 by Surface Gel Tek; MSDS: HCL (other reagents proprietary) (I've personally used the acid Gel product. The fumes were severe despite claims to the contrary and they are not using talc based upon clear appearance of the product); www.surfacegeltek.com, last accessed Sep. 18, 2019.

DURAPREP PREP100 Safe Concrete Etch by PPG; www.ppgpmc.com, last accessed Sep. 18, 2019.

Holdtight 102; MSDS: Amine Based; https://sandblastinc.com; last accessed Sep. 18, 2019.

Eastwood Metal Wash 7 oz (item #10120) by EastWood; MSDS: A proprietary blend of organic and inorganic compounds; www.eastwood.com; accessed Sep. 18, 2019.

CHLOR*RID Liquid Soluble Salt Remover by CHLOR Rid International, Inc.; MSDS: Acidic in Nature; www.chlor-rid.com; last accessed Sep. 18, 2019.

Hold*Blast by CHLOR Rid International, Inc.; MSDS: Alkanolamine: 25%; www.chlor-rid.com; last accessed Sep. 18, 2019.

* cited by examiner

METHOD, KIT, AND COMPOSITION FOR CORROSION REMOVAL

CROSS REFERENCE TO RELATED APPLICATIONS

This application claims benefit of U.S. Provisional Pat. App. No. 62/672,322, filed May 16, 2018, which application is incorporated herein by reference in its entirety.

TECHNICAL FIELD

The instant disclosure broadly relates to corrosion and scale removal methods, kits, and compositions, and more specifically to a two-stage corrosion and scale removal method and compositions therefor, and even more particularly to a two-stage corrosion and scale removal method and compositions where in a first stage of the method, a thixotropic acid gel is utilized.

BACKGROUND

Ferrous metal articles, non-ferrous articles, as well as non-metal articles have tendencies to exhibit corrosion over time due to environmental exposure. In addition, some articles that are exposed to certain environments can exhibit a buildup of scale (e.g., lime-scale) and/or their surfaces may become severely oxidized. Hence, prior to coating, e.g., painting, such articles and surfaces thereof must be treated in some fashion prior to use or coating, else the corrosion will continue to deteriorate the article and/or the applied coating will not sufficiently adhere to the article.

There are a variety of compositions and techniques directed to the removal and stoppage of corrosion or scale on such articles; however, each composition and technique includes inherent drawbacks that make use of those solutions difficult. For example, some solutions are difficult to apply to an article, while other solutions require special heightened care in use or an operator using such solution may be exposed to risk.

SUMMARY

The subject matter of the instant disclosure generally relates to methods, kits and compositions for removing corrosion or scale from ferrous and non-ferrous articles, as well as non-metal articles, or combinations thereof.

According to one aspect, a method of removing corrosion or scale from an article includes, in a first stage, exposing the article to an acid wash composition including a first acid component of 54-65 wt % acid, which includes 30-35 wt % HCl and 50-70 wt % $H_2O$, a second acid inhibitor/surfactant component comprising approximately 0.1-5.0 wt % ethoxylated alkyl mercaptan, and a third thixotropic gelling component comprising 35-46 wt % talc or fumed silica, which is sufficient to cause gelling of the acid wash composition.

According to another aspect, a method of removing corrosion or scale from an article includes, in a first stage, exposing the article to an acid wash composition including a first acid component having 0.1-40 wt % acid, which includes 24.4-24.57 wt % HCl, 3.90-7.26 wt % Phosphoric Acid, 1.13-1.70 wt % Oxalic Acid, 1.27-2.1 wt % Citric Acid, and 64.27-69.30 wt % $H_2O$, a second acid inhibitor/surfactant component comprising 0.001-2.0 wt % ethoxylated alkyl mercaptan, and a third thixotropic gelling agent component comprising 1-70 wt % Talc or Fumed silica sufficient to cause gelling of the acid wash composition.

According to aspects, the methods further include, in a second stage performed subsequent to the first stage, exposing the article to an acid neutralizing composition including bicarbonate, borax, isopropyl alcohol and water in amounts determined according to the equation:

$$T - \left[\frac{A \times T}{C} + S \times T + B \times T\right] = W,$$

wherein: T=total weight of acid neutralizing composition,
S=percentage of bicarbonate,
B=percentage of borax,
A=percentage of isopropyl alcohol,
C=concentration of isopropyl alcohol reagent, and,
W=weight of water in the acid neutralizing composition.

In some aspects of the methods, the acid neutralizing composition further includes 0.1% zinc chromate. In some aspects, the acid neutralizing composition further comprises 0.001-45.0 wt % ethylenediaminetetraacetic acid (EDTA) or EDTA—Na4, and in some aspects 0.5-5.5 wt % ethylenediaminetetraacetic acid (EDTA) or EDTA—Na4.

In some aspects of the methods, the first acid component includes 0.1-40 wt % acid, which includes 24.4 wt % HCl, 3.90 wt % Phosphoric Acid, 1.13 wt % Oxalic Acid, 1.27 wt % Citric Acid, and 69.30 wt % $H_2O$, a second acid inhibitor/surfactant component including 0.001-2.0 wt % ethoxylated alkyl mercaptan, and a third thixotropic gelling agent component including 1-70 wt % Talc or Fumed silica, sufficient to cause gelling of the acid wash composition.

In some aspects of the methods, in intermediate stage performed subsequent to the exposure of the article to the acid wash composition and before the article is exposed to the acid neutralizing composition, the acid wash composition is allowed to react with the article for a time period of from 30-60 minutes. In some aspects of the methods, the intermediate stage is performed at a temperature from 65-90 Deg. F, and in some aspects of the methods, the article is covered so as to reduce evaporation of the acid wash composition.

In some aspects of the methods, the article is exposed to the acid wash composition by one or more of a brushing, a dipping, or a spraying process to apply the acid wash composition to the article. In some aspects of the methods, the article is exposed to the acid neutralizing composition by one or more of a spraying, a dipping, or a wiping process to apply the acid neutralizing composition to the article. In some aspects the article may be dried after application of the acid neutralizing composition.

In some aspects of the methods, prior to exposing the article to the acid neutralizing composition, the first and intermediate stages are performed one or more times and include one or more water rinsing stages subsequent to each respective one or more of the intermediate stages. And, upon completion of a final intermediate stage or water rinsing stage, the article is exposed to the acid neutralizing composition in the second stage.

In some aspects, the instant disclosure is directed to a kit configured to remove corrosion or scale from a metal or a non-metal article, and the kit includes an acid wash composition including a first acid component having 54-65 wt % acid, which includes 30-35 wt % HCl and 65-70 wt % $H_2O$, a second acid inhibitor/surfactant component comprising approximately 0.1-5.0 wt % ethoxylated alkyl mercaptan, and a third thixotropic gelling component comprising 35-46 wt % talc or fumed silica sufficient to cause gelling of the acid wash composition.

In some aspects, the instant disclosure is directed to a kit configured to remove corrosion or scale from a metal or a non-metal article, and the kit includes an acid wash composition including a first acid component having 0.1-40 wt % acid, which includes 24.4-24.57 wt % HCl, 3.90-7.26 wt % Phosphoric Acid, 1.13-1.70 wt % Oxalic Acid, 1.27-2.1 wt % Citric Acid, and 64.27-69.30 wt % $H_2O$, a second acid inhibitor/surfactant component having 0.001-2.0 wt % ethoxylated alkyl mercaptan, and a third thixotropic gelling agent component comprising 1-70 wt % Talc or Fumed silica, sufficient to cause gelling of the acid wash composition.

In some aspects, the first acid component of the acid wash composition of the kit(s) includes 0.1-40 wt % acid, which includes 24.4 wt % HCl, 3.90 wt % Phosphoric Acid, 1.13 wt % Oxalic Acid, 1.27 wt % Citric Acid, and 69.30 wt % $H_2O$, a second acid inhibitor/surfactant component comprising 0.001-2.0 wt % ethoxylated alkyl mercaptan, and a third thixotropic gelling agent component comprising 1-70 wt % Talc or Fumed silica, sufficient to cause gelling of the acid wash composition.

In some aspects, the kit(s) can include an acid neutralizing composition including bicarbonate, borax, isopropyl alcohol and water in amounts determined according to the equation:

$$T-\left[\frac{A\times T}{C}+S\times T+B\times T\right]=W,$$

wherein: T=total weight of acid neutralizing composition,
S=percentage of bicarbonate,
B=percentage of borax,
A=percentage of isopropyl alcohol,
C=concentration of isopropyl alcohol reagent, and,
W=weight of water in the acid neutralizing composition.

In some aspects, the acid neutralizing composition of the kit(s) can include 0.1% zinc chromate. In some aspects, the acid neutralizing composition further comprises 0.001-45.0 wt % ethylenediaminetetraacetic acid (EDTA) or EDTA—Na4, and in some aspects 0.5-5.5 wt % ethylenediaminetetraacetic acid (EDTA) or EDTA—Na4.

In some aspects, the kit(s) further include instructions for removing corrosion from a metal or non-metal article using the acid wash composition and the acid neutralizing composition. In some aspects the instructions describe applying the acid wash composition to the metal or non-metal article, and applying the acid neutralizing composition to the metal or non-metal article in a subsequent step. In some aspects, the instructions describe applying the acid wash composition to the metal or non-metal article, allowing the acid wash composition to remain on the article for a time period of from 30-60 minutes at a temperature from 65-90 Deg. F., and applying the acid neutralizing composition to the metal or non-metal article to neutralize the acid wash composition. In some aspects, the instructions further describe applying the acid neutralizing composition to the metal or non-metal article, rinsing the metal or non-metal article with water, repeating the application of the acid wash composition and repeating the rinsing of the metal or non-metal article with water one or more times, and applying the acid neutralizing composition to the metal or non-metal article upon completing the one or more repeated applications of the acid wash composition and the one or more repeated rinses of the metal or non-metal article with water.

In aspects disclosed herein, there is described an acid wash composition for removing corrosion or scale from a metal or a non-metal article that includes a first acid component having 54-65 wt % acid, which includes 30-35 wt % HCl and 65-70 wt % $H_2O$, a second acid inhibitor/surfactant component comprising approximately 0.1-5.0 wt % ethoxylated alkyl mercaptan, and a third thixotropic gelling component comprising 35-46 wt % talc or fumed silica, sufficient to cause gelling of the acid wash composition.

In some aspects disclosed herein, there is described an acid wash composition for removing corrosion or scale from a metal or a non-metal article that includes a first acid component comprising 0.1-40 wt % acid, which includes 24.4-24.57 wt % HCl, 3.90-7.26 wt % Phosphoric Acid, 1.13-1.70 wt % Oxalic Acid, 1.27-2.1 wt % Citric Acid, and 64.27-69.30 wt % $H_2O$, a second acid inhibitor/surfactant component comprising 0.001-2.0 wt % ethoxylated alkyl mercaptan, and a third thixotropic gelling agent component comprising 1-70 wt % Talc or Fumed silica sufficient to cause gelling of the acid wash composition.

In some aspects, the first acid component of the acid wash composition includes 0.1-40 wt % acid, which includes 24.4 wt % HCl, 3.90 wt % Phosphoric Acid, 1.13 wt % Oxalic Acid, 1.27 wt % Citric Acid, and 69.30 wt % $H_2O$, a second acid inhibitor/surfactant component comprising 0.001-2.0 wt % ethoxylated alkyl mercaptan, and a third thixotropic gelling agent component comprising 1-70 wt % Talc or Fumed silica, sufficient to cause gelling of the acid wash composition.

Other aspects, features and advantages of one or more embodiments described herein will be readily appreciable from the following detailed description and from the accompanying drawings and claims.

BRIEF DESCRIPTION OF THE DRAWINGS

The nature and mode of operation of methods and compositions according to the instant disclosure will now be more fully described in the following detailed description taken with the accompanying drawing figures, in which.

DETAILED DESCRIPTION

Figure 1:
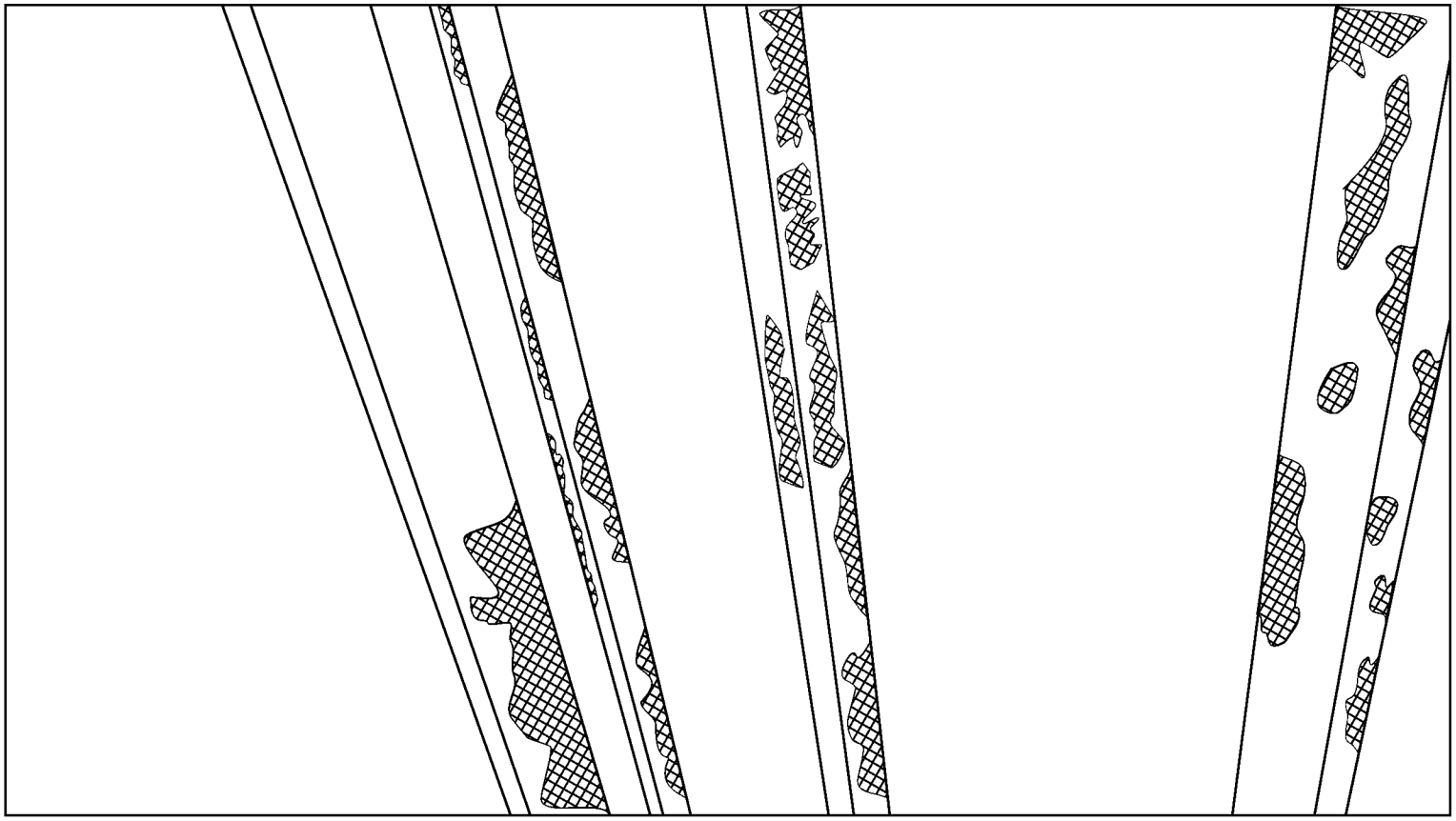
FIG. 1 is an illustration of an article exhibiting corrosion thereon.
Figure 2:
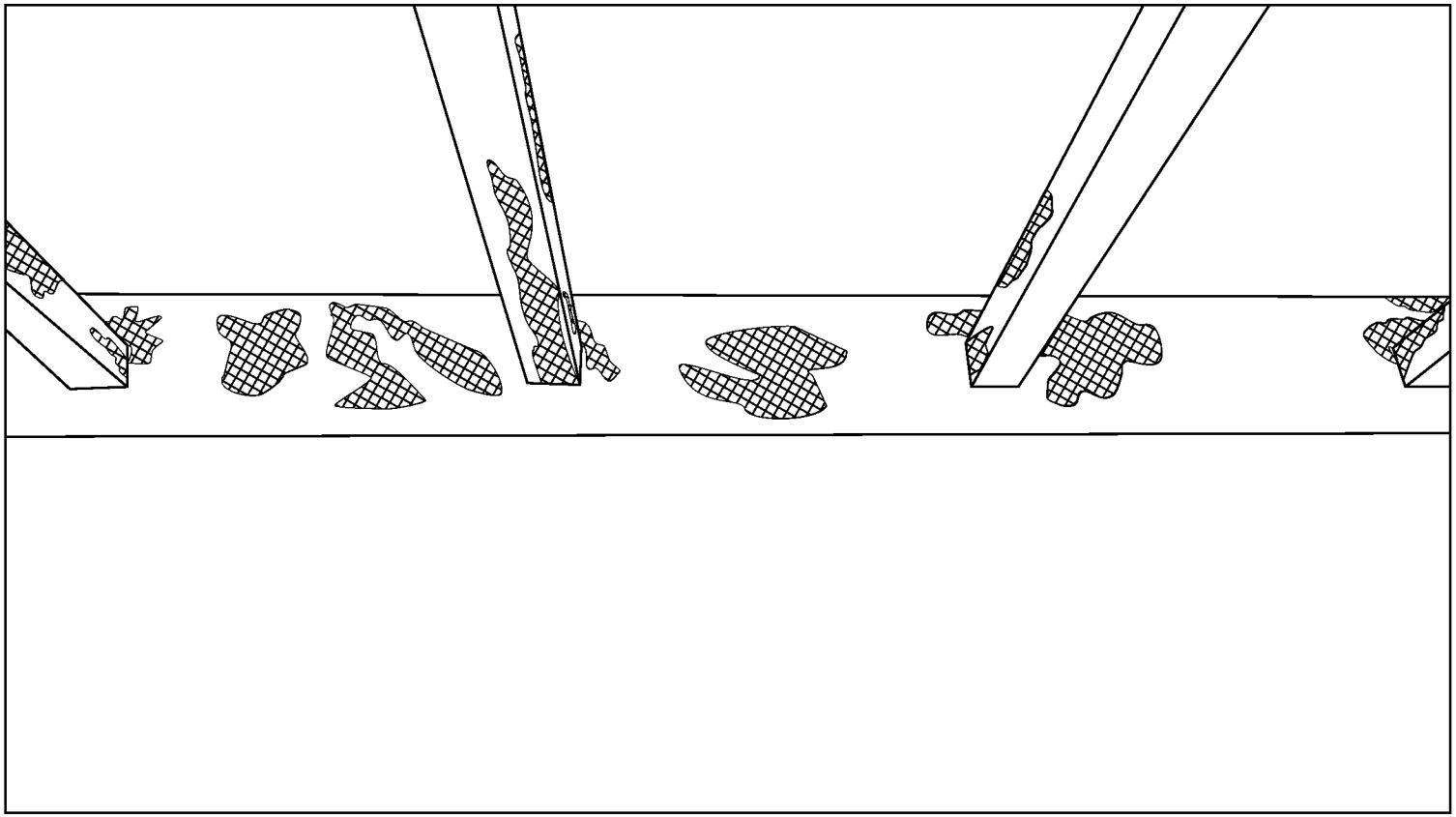
FIG. 2 is an illustration of an article exhibiting corrosion thereon.
Figure 3:
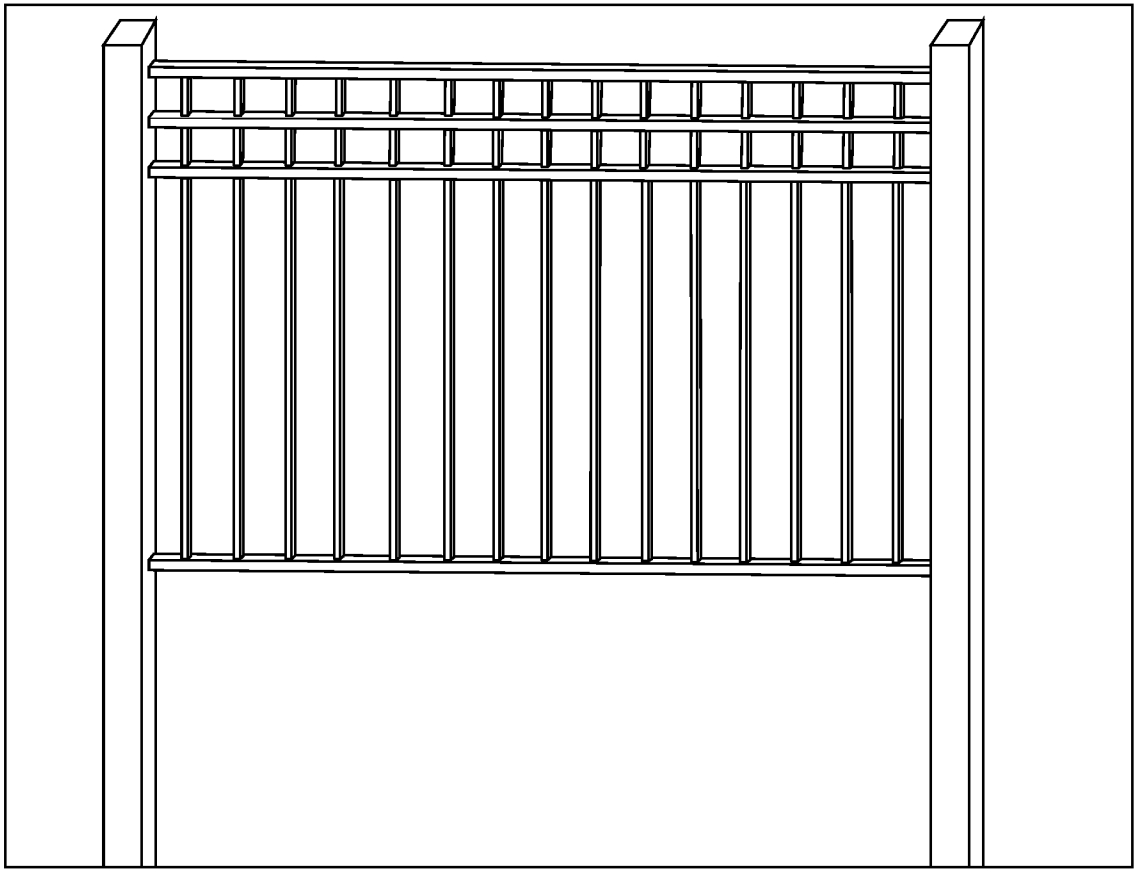
FIG. 3 is an illustration of the article of FIG. 1 after treatment with the present acid composition and subsequent treatment with the neutralizing and rinsing composition; and, FIG. 4 is an illustration of the article of FIG. 2 after treatment with the present acid composition and subsequent treatment with the neutralizing and rinsing composition.
Figure 4:
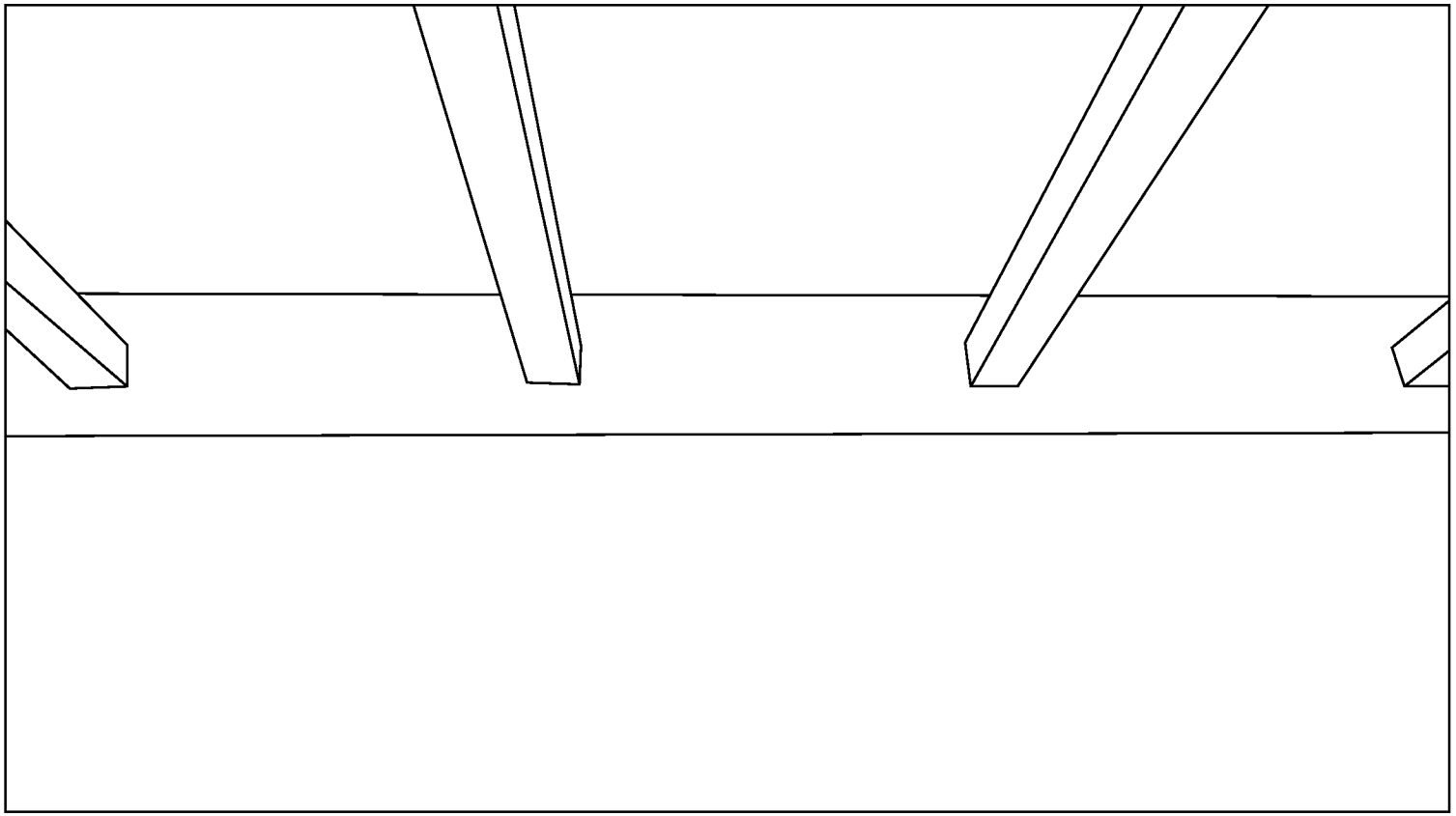

At the outset, it should be appreciated that like drawing numbers on different drawing views identify identical, or functionally similar, structural elements. While the present compositions and methods are described with respect to what are presently considered to be the exemplary aspects, it is to be understood that the instant disclosure and claims are not limited to the disclosed exemplary aspects.

Furthermore, it is understood that the compositions and methods disclosed herein are not limited to the particular methodologies, materials and modifications described and as such may, of course, vary. It is also understood that the terminology used herein is for the purpose of describing particular aspects only, and is not intended to limit the scope of the compositions and methods described herein, which are limited only by the appended claims.

Unless defined otherwise, all technical and scientific terms used herein have the same meaning as commonly understood to one of ordinary skill in the art to which this disclosure belongs. Moreover, as used herein, the phrases "comprises at least one of" and "comprising at least one of" in combination with a system or element is intended to mean that the system or element includes one or more of the elements listed after the phrase. For example, a device comprising at least one of: a first element; a second element; and, a third element, is intended to be construed as any one of the following structural arrangements: a device comprising a first element; a device comprising a second element; a device comprising a third element; a device comprising a first element and a second element; a device comprising a first element and a third element; a device comprising a first element, a second element and a third element; or, a device comprising a second element and a third element. A similar interpretation is intended when the phrase "used in at least one of:" is used herein. Furthermore, as used herein, "and/or" is intended to mean a grammatical conjunction used to indicate that one or more of the elements or conditions recited may be included or occur. For example, a device comprising a first element, a second element and/or a third element, is intended to be construed as any one of the following structural arrangements: a device comprising a first element; a device comprising a second element; a device comprising a third element; a device comprising a first element and a second element; a device comprising a first element and a third element; a device comprising a first element, a second element and a third element; or, a device comprising a second element and a third element.

Additionally, as used herein the terms "corrosion", "scale", "mill-scale", "lime-scale" and like terms are intended to be applied according to their ordinary and customary meanings in the technical filed(s), e.g., oxidation, surface oxidation, rust, residues from manufacturing processes, compositions deposited on a surface or surface buildup, etc., but may also refer to any undesirable surface residue whose removal may be desired.

Furthermore, it should be understood that while a number of examples and/or descriptions set forth herein describe the use of the compounds and methods described herein in association with ferrous metals, it should be appreciated that the compositions and methods can be applied to non-ferrous metals, non-metals, and combinations thereof.

Although any methods, devices or materials similar or equivalent to those described herein can be used in the practice or testing of the present composition, example and preferred methods, devices, and materials are now described.

The present methods and compositions provide means to remove corrosion, rust and light mill scale, etc. from ferrous, non-ferrous, and non-metal articles, and articles formed of combinations thereof. It has been found that the present methods and compositions can remove surface residues, such as light mill scale from, for example, metal articles that are ¼" thick and under; however, while thicker metal articles may also be treated, such treatment typically requires more than a single application of the compositions of the instant disclosure in order to remove such surface residues and heavier mill scale. In addition, rust on articles formed from ferrous metals can be removed from any thickness. The compositions of the instant disclosure upon mixing forms a thixotropic gel that can cling to vertical and horizontal surfaces, as well as lightly to overhead substrates.

It has been found that compositions formulated in accordance with the instant disclosure perform more effectively on articles, e.g., ferrous metals, that are washed and rinsed with soap and water, and subsequently fully dried prior to application of the compositions. In short, any waxes, oils, water and/or any other barriers between the articles to be treated and the compositions will negatively affect the outcome.

The method and compositions in accordance with the instant disclosure broadly comprise two stages: 1) an acid stage; and, 2) a neutralization/rinse stage. The compositions used in each stage are discussed herebelow, with the method of performing each stage discussed thereafter.

The Acid Stage

An embodiment of an acid composition in accordance with the instant disclosure includes:

One (1) gallon of 31.45% muriatic acid (approximately 4200 grams)

Eight (8) grams of Burco® TME-S 2,700-3,500 grams of talc

It should be appreciated that the foregoing formulation may be modified or alternative components may be included. For example, the muriatic acid may be replaced with one (1) gallon of a known acid composition comprising a proprietary blend of components which include but are not limited to hydrochloric acid and phosphoric acid. One benefit of using the known acid composition in place of muriatic acid is that the composition is formulated to result in lower fumes thereby making it more convenient for application and removal.

One analysis of the known acid composition indicated that it has total solids at 105° C. of 3.77%, a total ash at 550° C. of 0.41% and a specific gravity of 1.114 g/ml. Energy Dispersive Spectroscopy (EDS) of ashes indicated the likely presence of carbon, oxygen, silicon and phosphorous. Ion Chromatography (IC) indicated the likely presence of $Cl^-$ and $PO_{3-}$. The average of titrimetric and IC determinations indicated that the known acid composition likely includes 24.4% w/v hydrochloric acid. IC determinations indicated that the known acid composition likely includes 3.9% w/v phosphoric acid. It is believed that the decrease in fumes afforded by the known acid composition may result from a combination of $H_3PO_4$ and a slight dilution of the HCl which causes a dramatic change in the vapor pressure of the acid. For example, the vapor pressure drops from 14.5 KPa for a 36% w/w HCl solution to 2.13 KPa for a 30% w/w HCl solution.

Another analysis of the known acid composition indicated that it has total solids of 3.77%, a total ash at 600° C. of 0.41% and a pH of 0.49. Energy Dispersive Spectroscopy (EDS) of ashes indicated the likely presence of carbon, oxygen, silicon and phosphorous. Ion chromatography (IC) and volumetric titration indicated that the composition likely includes 24.4% w/v hydrochloric acid and 3.9% w/v phosphoric acid. High performance liquid chromatography (HPLC) indicated that the composition likely included 1.13% w/v oxalic acid, and 1.277% w/v citric acid.

In a reformulation study, it was proposed that a potential reformulation of the known acid composition would likely include 24.4-24.67% w/v hydrochloric acid, 3.9% w/v phosphoric acid, 1.13% w/v oxalic acid, 1.27% w/v citric acid, and 69.3% w/v water.

In a further study, it was found that an acid component exhibiting desirable vapor characteristics (hereinafter "the Sample") would likely include 2.1% w/v citric acid, 1.7% w/v oxalic acid, 24.67% w/v hydrochloric acid, 7.26% w/v phosphoric acid, and 64.27% w/v water. In one aspect of preparing the Sample, the above-described components were mixed sequentially in the order presented above, i.e., citric acid, followed by oxalic acid, followed by hydrochloric acid, followed by phosphoric acid, and, finally, water. In the further study, the vapor content of the Sample was quantified using a turbidimeter and compared with the vapor content of the known acid composition. For such purposes, a 0.25% (w/v) solution of Silver nitrate was prepared and taken in two separate vials. Equal volumes of the Sample and the known acid composition were each taken in two separate flasks, each covered with a stopper fit with an air syringe. After exposing the syringes to the flasks for equal amounts of time (2 minutes), the syringes filled with vapor up to a fixed volume. The vapor collected from each of the Sample and the known acid composition were quickly transferred to respective vials where they were bubbled into the Silver nitrate solution, thus turning the Silver nitrate solutions turbid due to silver chloride formation. The turbidity of both exposed Silver Nitrate solutions was then measured using a turbidimeter to obtain a quantitative measure of vapor content of each. As a result of the above, it was found that the solution exposed to the known acid composition vapor had a turbidity, as measured in Nephalometric Turbidity Units (NTU), of 91.6 NTUs, whereas the solution exposed the Sample vapor had a turbidity of 74.5 NTUs, generally indicative of a lower vapor content. Hence, the vapor pressure of the Sample suggests more favorable characteristics as compared to the known acid composition.

Burco® TME-S is an acid inhibitor and surfactant manufactured by Burlington Chemical Company of Burlington, N.C. The component is ethoxylated alkyl mercaptan and is in the range of 0.001-2%, with a typical formula including 0.005-0.01%. This component protects the base metal from acid attack, concentrates the power of the acid on the rust and/or mill scale as opposed to the base metal, and helps the talc mixture wet out better, i.e., relax. It has been found that including higher concentrations of this component in a composition according to the instant disclosure offers additional base metal protection. It should be appreciated that there are numerous other inhibitors that may be used, e.g., Activol® 1803, Potentol® 2803, Potentol® 2804, BONDERITE® S-AD 145L, BONDERITE® S-AD 213 SF, BONDERITE® S-AD 221 SF, BONDERITE® S-AD 50™, BONDERITE® S-AD 3305™, Armohib® 28, Armohib® 31, and the inhibitors described in U.S. Pat. Nos. 3,514,410, 2,814,593, and 4,927,550, although Burco® TME-S is more environmentally friendly.

Talc is used to "thicken" the overall composition. It has been found that in some instances the talc will bubble and drastically increase in volume when added to the HCl and the mixture must be stirred for 15 minutes in a large container. Talc should not react with the HCl, however there may be impurities in the talc depending on the source of the material. It has been found that maximum acid strength of the present composition may be achieved by pretreating the talc. Thus, the talc may be pretreated with a dilute solution of HCl until all the impurities have reacted, i.e., the bubbling subsides. The dilute HCl solution is then removed from the talc by drying, filtering, squeezing, etc. to assist in separation of the two components. Subsequently, the pretreated talc is mixed with the full strength HCl acid. Using the foregoing technique ensures that the acid is not "consumed" by reacting with the impurities in the talc. It has also been found that the talc may be rinsed after use in the present composition and then, after drying the talc, reused in a subsequent batch of the present composition.

Some differences were noted when using fumed silica as the gelling agent as opposed to talc. When Burco® TME-S was added after the fumed silica, it resulted in the gel greatly increasing in viscosity to almost a petroleum jelly consistency. If the Burco® TME-S was added before the fumed silica, the fumed silica becomes difficult to mix into the acid. The foregoing information may be useful if it becomes more desirable to use fumed silica as opposed to talc, since it may help determine the minimum amount of silica gel to include.

It has been found that the final resulting acid solution should be filtered through a 400-800 micron filter to remove any clumps. Filtration permits the acid solution to be passed through a spraying device thereby making spray application of the solution an option. It should be appreciated that the foregoing example embodiment is but one embodiment of the composition used at the acid stage, and variation on the formulation may occur. For example, the muriatic acid may range from 0.1%-40.0%, the acid inhibitor may range from 0.001%-2.0%, and the talc may range from 1.0%-70.0%.

The Neutralization/Rinse Stage

An embodiment of a neutralization/rinse composition in accordance with the instant disclosure is determined in accordance with the following equation:

$$T-\left[\frac{A\times T}{C}+S\times T+B\times T\right]=W$$

Wherein: T=total by weight of the amount desired to be mixed

S=percentage of bicarbonate

B=percentage of borax in decimal form (e.g., 5%=0.05)

A=percentage (in decimal form) of isopropyl alcohol desired in final composition C=concentration of isopropyl alcohol reagent (e.g., 70% isopropyl alcohol is 0.70)

W=weight of water in composition

It should be appreciated that the foregoing equation may result in a composition where all components do not fully dissolve in the water. Moreover, it should be further appreciated that portions of the equation may be used separately to determine how much of each component to include. For example, S×T=total amount of sodium bicarbonate to include, (A×T)/C=total amount of isopropyl alcohol to include at a given concentration of reagent to achieve a desired percentage in the final neutralization/rinse composition, and B×T=total amount of borax to include.

An embodiment of a neutralization/rinse composition in accordance with the instant disclosure, formulated using the above equation may be as follows:

T=4360.58 g of neutralization/rinse composition

S=0.047 (4.7%) of baking soda (204.94 g of sodium bicarbonate)

B=0.019 (1.9%) of borax (82.85 g of borax)

A=0.047(4.7%) of isopropyl alcohol in the final composition (292.78 g of isopropyl alcohol)

C=0.70 (70%) concentration of isopropyl alcohol reagent added to neutralization/rinse composition W=3780 g of water (One (1) gallon of water)

It has been found that sodium bicarbonate neutralizes the muriatic acid used in the acid gel composition. Moreover, sodium bicarbonate makes ferrous carbonate from ferrous chloride which formed as HCl acid dissolves rust. In experiments, it was found that potassium bicarbonate may be a suitable substitute for sodium bicarbonate. Borax was found to help raise the pH, which is believed to help form a delicate protective oxide layer, and has the additional benefit of being a corrosion inhibitor. Isopropyl alcohol improves the rinsing and wetting out of the neutralization/rinse composition, and it evaporates while leaving little to no residue. It should be appreciated that other solvents and/or surfactants could be used. Hot water may be used as it helps dissolve the various soluble component more quickly. It has been found that the pH level should be 8.5-9, however other pH levels are also usable, e.g., higher or lower than the foregoing range. It is believed that lower pH levels inhibit formation of the delicate protective oxide layer on the ferrous metal article, while higher pH levels may inhibit paint adhesion if any residue remains.

The neutralization/rinse composition may also include Ethylenediaminetetraacetic acid (EDTA) and/or or EDTA-Na4, which have shown to be valuable additives to the acid neutralizing composition, which are highly soluble in the described formulations. EDTA and EDTA-NA4 are believed to chelate iron ions and therefore help to delay/stop flash rusting and can be added to the acid neutralizing composition at 0.001 to 45 wt %, and a typical range is from 0.5-5 wt %.

Method of Using Acid Composition and Neutralization/Rinse Composition

An acid composition in accordance with the instant disclosure should be stirred thoroughly before use. The acid composition may be applied via a variety of methods, e.g., brush, pour, dipped, but it has been found that application via a pump-up acid-resistant sprayer, e.g., Sprayer-Plus™ Model: 20ACID sold by Sprayers Plus of Seattle, Wash., is efficient. If sprayed, the acid should be filtered through a 400-800 micron filter, otherwise the sprayer will regularly clog. In short, the smallest dirt particle or leaf will plug the sprayer nozzle. Moreover, positioning the sprayer head closer to the ferrous metal article and pressing the trigger lightly results in a thicker application of the present acid gel composition.

Upon application, the acid composition is allowed to react on the surface of the ferrous metal article for about 30-60 minutes, most preferably in a location where evaporation is not accelerated, e.g., in the shade and ideally between 65-90° F. It has been found that results may be further improved, especially if the acid composition is used outdoors and the humidity is low and/or there is wind, by covering the treated ferrous metal article with a covering, e.g., a tarp, to slow evaporation. It has been further found that the present acid composition including talc rinses more easily than the same composition including a fumed silica. Moreover, talc is much less expensive than fumed silica.

The following reactions are believed to occur upon application of the present acid composition to a corroded ferrous metal.

Scale (FeO) with the present acid composition:

$$FeO+2HCl \rightarrow FeCl_2+H_2O$$

For example, 72 pounds of iron oxide reacts with 73 pounds of hydrogen chloride to make 127 pounds of ferrous chloride and 18 pounds water.

Iron oxide with the present acid composition:

$$Fe_2O_3+6HCl \rightarrow 2FeCl_3+3H_2O$$

Magnetite with the present acid composition:

$$Fe_3O_4+8HCl \rightarrow FeCl_2+2FeCl_3+4H_2O$$

After treatment with the acid composition, the ferrous metal article is rinsed with the neutralization/rinse composition. The neutralization/rinse composition can be applied through numerous methods including but not limited to a second pump-up sprayer, a hand-held spray bottle, rags wetted with the composition, power washer, etc. If a second pump-up sprayer is used, it can be a less expensive model as it does not need to be resistant to strong acid materials. The neutralization/rinse composition should be sprayed in long strokes to "chase" the acid composition off the substrate. The substrate should ideally not remain in a pool of rinsed off acid material.

The neutralization/rinse solution can be applied with a pump-up sprayer, e.g., Deck & Home Garden Sprayer, after filtering through a 400 micron filter. It has been found that the acid composition rinses very well with light pressure while moving in strokes generally in one direction.

It is believed that the neutralization/rinse composition may improve corrosion resistance further by including very small additions of zinc chromate. Although considered a carcinogen, if its total quantity is maintained at less than 0.1%, OSHA does not require reporting of its use.

The following reactions are believed to occur upon application of the present neutralization/rinse composition following prior treatment with the acid gel composition.

$$HCl+NaHCO_3 \rightarrow NaCl+H_2O+CO_2$$

$$FeCl_2+2NaHCO_3 \rightarrow FeCO_3+H_2O+CO_2+2NaCl$$

$$FeCl_3+2Na_2B_4O_7+3O_2 \rightarrow 4NaBO_2+2Fe(BO_3)_2+3Cl_2$$

$$2FeCl_2+2Na_2B_4O_7+3O_2 \rightarrow 4NaBO_2+2Fe(BO_3)_2+2Cl_2$$

$$Na_2B_4O_7+2HCl+5H_2O \rightarrow 2NaCl+4H_3BO_3$$

After rinsing the ferrous metal article, the article should be moved away from the rinsing composition to minimize possible flash rusting due to humidity and/or fumes/gases. Moreover, improved performance was obtained by wiping the article dry using clean rags, paper towels, etc. wiped continuously in one direction.

It has been found that in some instances the acid gel composition will leave a very light layer of unremoved mill scale, referred to as "ghost mill scale." Areas having ghost mill scale tend to flash rust faster than other areas. The neutralization/rinse composition described above helps prevent ghost mill scale regions from flash rusting versus using a pure baking soda/water rinse solution.

Ferrous metal articles will severely rust if no neutralization/rinse composition is used. Ferrous metal articles will flash rust to a lesser extent without wiping. Portions of ferrous metal substrates that were not sufficiently neutralized/rinsed will self-indicate by quickly turning to green color. Such portions can be retreated with the present acid composition for less than a minute and re-neutralized/rinsed. It has been found that continuing to rinse a green portion without acid treatment will not prevent that portion from rusting.

If multiple treatments are desired for heavy mill scale/rust, a technician can rinse the acid gel composition away with plain water, i.e., saving the neutralization/rinse solution. The substrate should be fully dried, it will flash rust, and immediately retreated with the present acid composition for 30-60 minutes. The foregoing cycle can be repeated many times. However, the final rinse should be performed with the neutralization/rinse formula as described above. It has been found that if retreatment with the acid gel composition is desired after neutralization and rinsing has occurred, rinsing with plain water and drying before application of the acid gel composition maximizes the acid's effect.

The foregoing two stage process should only be used in areas that can be wiped clean and dry. It should not be used in areas that would trap either composition, cannot be wiped dry, or would rinse poorly. However, it has been found that areas capable of trapping liquid may be masked off, e.g., using removable weather-strip type caulking (such as the type used to temporarily weatherproof windows and doors), to seal off seams/crevices from liquid contact. After application of the acid gel and neutralization/rinse compositions, the masking material may be removed. Moreover, the foregoing compositions may have other possible uses, e.g., etching concrete, cleaning, etc.

Although it is believed that the neutralization stage renders the remaining components safe, if waste treatment is required, the following method may be used. The collected neutralization/rinse solution can be fully neutralized by mixing with limestone powder or rocks, with the powder being the fastest. The final pH should be raised to at least 6.6, followed by subsequent passage of air through the solution, e.g., by bubbling air through. The bubbling air converts $FeCl_2$ to the less soluble $FeCl_3$. Hydrated lime is added until strong coagulation and flocculation occur. After flocculation has completed, the resulting composition can be poured through a large filter supported in a large pot/funnel.

Although there are other acid gels and rinses made and used, the acid composition according to the instant disclosure and the neutralization/rinse composition according to the instant disclosure provide benefits that other compositions have failed to provide. For example, the neutralization/rinse composition according to the instant disclosure is easy to use as it can be applied with a pump-up sprayer, as opposed to requiring a power washer. The acid composition self indicates by turning green those portions where it has not been sufficiently rinsed. Moreover, the acid and neutralization/rinse compositions of the instant disclosure remove chlorides from the surfaces of the treated articles, thereby minimizing or preventing the severe flash rust known to be caused by residual chlorides. Pretreating the talc during preparation of the acid composition provides a full-strength acid gel for use in rust removal. Lastly, acid compositions that include low fume HCl, e.g., compositions including known acid compositions or compositions described herein, are easier to use, minimize flash rusting, and are safer for technicians.

Thus, it is seen that the objects of the instant disclosure are efficiently obtained, although modifications and changes to the compositions and methods should be readily apparent to those having ordinary skill in the art, which modifications are intended to be within the spirit and scope of the compositions and methods as claimed. It also is understood that the foregoing description is illustrative of compositions and methods in accordance with the instant disclosure and should not be considered as limiting. Therefore, other embodiments of the compositions and methods disclosed herein are possible without departing from the spirit and scope thereof.

What is claimed is:

1. A kit configured to remove corrosion or scale from a metal or a non-metal article, the kit comprising:

an acid wash composition comprising:

a first acid component comprising 54-65 wt % acid including 30-35 wt % HCl and 65-70 wt % $H_2O$, a second acid inhibitor/surfactant component comprising ~0.1-5.0 wt % ethoxylated alkyl mercaptan, and a third thixotropic gelling component comprising 35-46 wt % talc or fumed silica sufficient to cause gelling of the acid wash composition; or a first acid component comprising 0.1-40 wt % acid including 24.4-24.57 wt % HCl, 3.90-7.26 wt % Phosphoric Acid, 1.13-1.70 wt % Oxalic Acid, 1.27-2.1 wt % Citric Acid, and 64.27-69.30 wt % $H_2O$, a second acid inhibitor/surfactant component comprising 0.001-2.0 wt % ethoxylated alkyl mercaptan, and a third thixotropic gelling agent component comprising 1-70 wt % Talc or Fumed silica sufficient to cause gelling of the acid wash composition; and an acid neutralizing composition comprising bicarbonate, borax, isopropyl alcohol and water in amounts determined according to the equation:

$$T-\left[\frac{A\times T}{C}+S\times T+B\times T\right]=W,$$

wherein

T=total weight of acid neutralizing composition,

S=percentage of bicarbonate,

B=percentage of borax,

A=percentage of isopropyl alcohol,

C=concentration of isopropyl alcohol reagent, and,

W=weight of water in the acid neutralizing composition.

2. The kit of claim 1, wherein the first acid component comprises:

0.1-40 wt % acid including 24.4 wt % HCl, 3.90 wt % Phosphoric Acid, 1.13 wt % Oxalic Acid, 1.27 wt % Citric Acid, and 69.30 wt % $H_2O$, a second acid inhibitor/surfactant component comprising 0.001-2.0 wt % ethoxylated alkyl mercaptan, and a third thixotropic gelling agent component comprising 1-70 wt % Talc or Fumed silica sufficient to cause gelling of the acid wash composition.

3. The kit of claim 1, wherein the acid neutralizing composition further includes 0.1% zinc chromate.

4. The kit of claim 1, further comprising instructions for removing corrosion from a metal or non-metal article using the acid wash composition and the acid neutralizing composition, wherein the instructions comprise:

applying the acid wash composition to the metal or non-metal article;

allowing the acid wash composition to remain on the article for a time period of from 30-60 minutes at a temperature from 65-90 Deg. F.; and, applying the acid neutralizing composition to the metal or non-metal article in a subsequent step.

5. The kit of claim 1, wherein the third thixotropic gelling component comprises talc.

6. The kit of claim 1, wherein the acid neutralizing composition further comprises 0.001-45.0 wt % ethylenediaminetetraacetic acid (EDTA) or EDTA—Na4.

7. The kit of claim 6, wherein the acid neutralizing composition comprises 0.5-5.5 wt % ethylenediaminetetraacetic acid (EDTA) or EDTA—Na4.

8. An acid wash composition for removing corrosion or scale from a metal or a non-metal article, the composition comprising:

a first acid component comprising 54-65 wt % acid including 30-35 wt % HCl and 65-70 wt % $H_2O$, a second acid inhibitor/surfactant component comprising ~0.1-5.0 wt % ethoxylated alkyl mercaptan, and a third thixotropic gelling component comprising 35-46 wt % talc or fumed silica sufficient to cause gelling of the acid wash composition; or a first acid component comprising 0.1-40 wt % acid including 24.4-24.57 wt % HCl, 3.90-7.26 wt % Phosphoric Acid, 1.13-1.70 wt % Oxalic Acid, 1.27-2.1 wt % Citric Acid, and 64.27-69.30 wt % $H_2O$, a second acid inhibitor/surfactant component comprising 0.001-2.0 wt % ethoxylated alkyl mercaptan, and a third thixotropic gelling agent component comprising 1-70 wt % Talc or Fumed silica sufficient to cause gelling of the acid wash composition.

9. The acid wash composition of claim 8, wherein the first acid component comprises:

0.1-40 wt % acid including 24.4 wt % HCl, 3.90 wt % Phosphoric Acid, 1.13 wt % Oxalic Acid, 1.27 wt % Citric Acid, and 69.30 wt % $H_2O$, a second acid inhibitor/surfactant component comprising 0.001-2.0 wt % ethoxylated alkyl mercaptan, and a third thixotropic gelling agent component comprising 1-70 wt % Talc or Fumed silica sufficient to cause gelling of the acid wash composition.

10. The acid wash composition of claim 8, wherein the third thixotropic gelling component comprises talc.

11. The kit of claim 4, wherein the instructions further comprise:

applying the acid neutralizing composition to the metal or non-metal article, rinsing the metal or non-metal article with water;

repeating the application of the acid wash composition and repeating the rinsing of the metal or non-metal article with water one or more times; and, applying the acid neutralizing composition to the metal or non-metal article upon completing the one or more repeated applications of the acid wash composition and the one or more repeated rinses of the metal or non-metal article with water.

* * * * *